United States Patent [19]

Ide

[11] 4,056,265

[45] Nov. 1, 1977

[54] MACHINE FOR INDOOR RUNNING

[76] Inventor: Azuma Ide, 5-213 go, 33-ban, 2-chome, Takashimadaira, Itabashi, Tokyo, Japan

[21] Appl. No.: 731,219

[22] Filed: Oct. 12, 1976

[30] Foreign Application Priority Data

July 14, 1976 Japan ..... 51-83870

[51] Int. Cl.[2] ..... A63B 23/04

[52] U.S. Cl. ..... 272/70; 235/99 R; 272/141; 272/DIG. 5

[58] Field of Search ..... 272/70, 69, 70.3, 100, 272/116, 132, 134, 135, 136, 137, 138, 140, 141, DIG. 4, DIG. 5; 35/29 R; 128/25 R, 25 B; 73/379, 381; 235/105, 99

[56] References Cited

U.S. PATENT DOCUMENTS

| | | | |
|---|---|---|---|
| 69,688 | 10/1867 | Melling | 235/99 R |
| 146,429 | 1/1874 | Burchell | 235/99 R X |
| 187,464 | 2/1877 | Harry | 235/99 R |
| 198,786 | 1/1878 | Beeson | 235/99 R |
| 206,480 | 7/1878 | Phipps | 235/99 R |
| 569,543 | 10/1896 | Cling | 235/99 R |
| 1,000,278 | 8/1911 | McGahey | 235/99 R |
| 3,295,847 | 1/1967 | Matt, Sr. | 272/141 |
| 3,580,083 | 5/1971 | Zipser | 272/69 X |
| 3,627,313 | 12/1971 | Schonfeld | 272/69 X |
| 3,635,399 | 1/1972 | Dahlquist | 235/105 |
| 3,638,940 | 2/1972 | Mehaulic | 272/141 |
| 3,818,194 | 6/1974 | Biro | 235/105 |
| 3,834,702 | 9/1974 | Bliss | 272/69 X |

*Primary Examiner*—Richard C. Pinkham
*Assistant Examiner*—Arnold W. Kramer
*Attorney, Agent, or Firm*—Oblon, Fisher, Spivak, McClelland & Maier

[57] ABSTRACT

An indoor running machine comprising a machine body having a drum accommodating section formed at the front edge; a vertically movable footboard provided on top of the body on the rear end side of the drum accommodating section and spring biased in the upward direction; a ratchet gear provided within the body and adapted to rotate pitch by pitch with the vertical movement of the footboard; and a rotary drum provided within the drum accommodating section of the body and adapted to be coupled to the rotation of the ratchet gear via a series of large and small transmitting gears. The outer periphery of the rotary drum is provided with a colored indicating surface of increasing width from one end to the other end in the direction of the axis opposite to the direction of rotation. The top of the drum accommodating section positioned directly above the rotary drum is provided with a display window of a slit-like form along the axial direction of the rotary drum, the display window being provided with running distance indicating graduations permitting the rate of increase of the colored indicating surface appearing on the display window with the rotation of said rotary drum to be read out in terms of the running distance.

1 Claim, 9 Drawing Figures

MACHINE FOR INDOOR RUNNING

BACKGROUND OF THE INVENTION

1. Field of the Invention

This invention relates to a machine for indoor running intended for one who wants running exercise in athletic clubs or at home for maintaining health.

2. Description of the Prior Art

In the past several training tools of this sort have been put to practical use. However, in such tools the number of steps is counted and is displayed to the training runner by a mere numeral. Therefore, the display is very abstract, and the indicated number of steps never indicates the running distance covered. In this respect, running machines of this sort are very unreliable.

BRIEF SUMMARY OF THE INVENTION

It is therefore one object of the present invention to provide a very handly and satisfactory running machine in which the number of steps can be displayed in an analog fashion.

The object of the present invention is achieved by an indoor running machine in which a colored indicating surface is displayed on a slit-like display window provided with running distance-indicating graduations from one end to the other end thereof such that its width gradually increases according to the number of steps on the footboard and permits the running distance to be read out from the rate of increase of width of the colored indicating surface.

The foregoing as well as other objects, features, and advantages of the present invention will become more apparent from the following detailed description taken in conjunction with the appended drawings.

BRIEF DESCRIPTION OF THE DRAWING

The drawing illustrates one embodiment of the invention.

DETAILED DESCRIPTION OF THE PREFERRED EMBODIMENT

Figure 1:
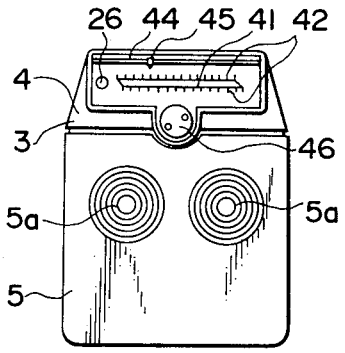
FIG. 1 is a plan view.
Figure 2:
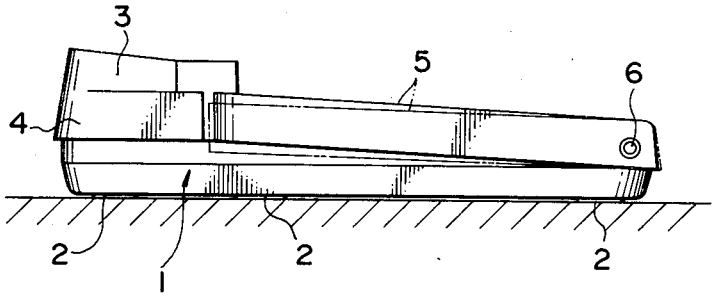
FIG. 2 is an enlarged-scale side view.
Figure 3:
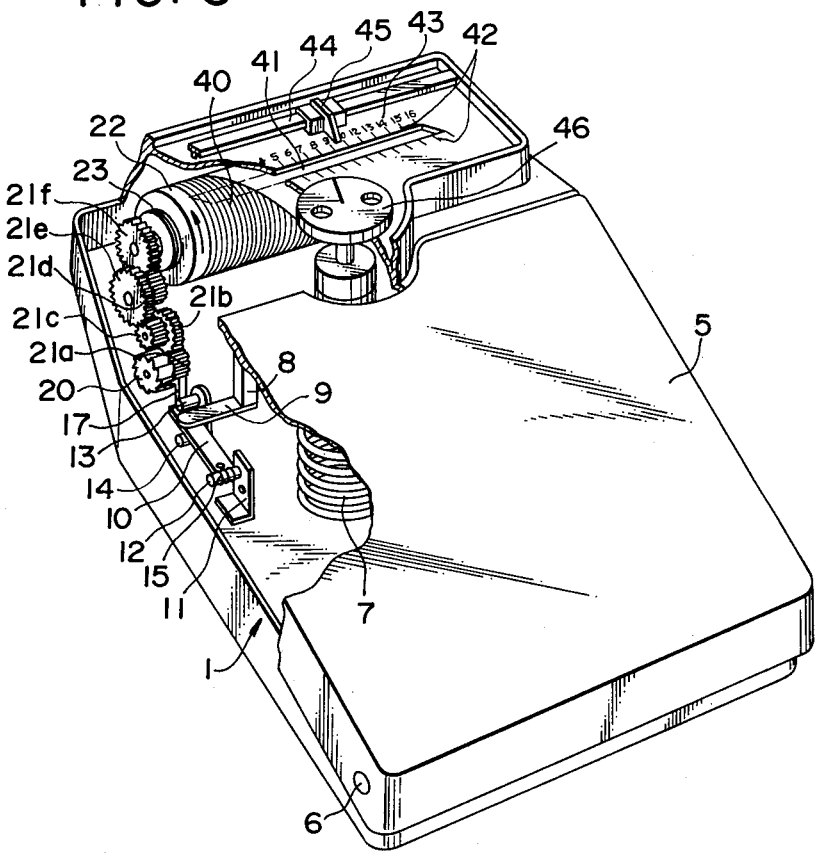
FIG. 3 is a perspective view, partly broken away, showing the same embodiment.
Figure 4:
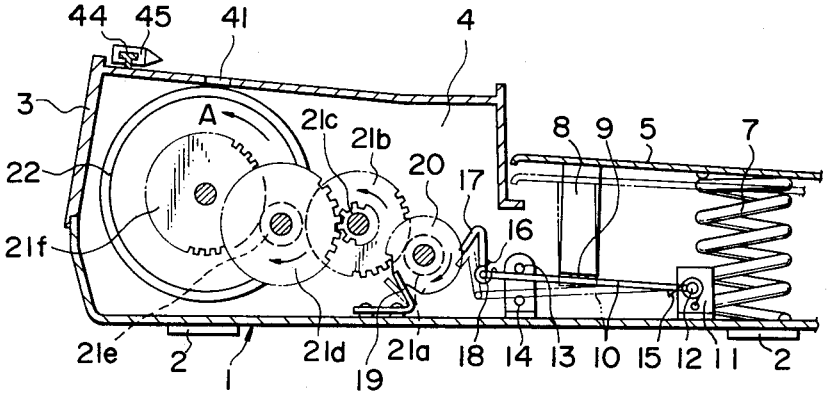
FIG. 4 is a side view, partly broken away, of a part of the same embodiment viewed from one side.

Referring now to the drawings, wherein like reference numerals designate identical or corresponding parts throughout the several views, and more particularly to FIG. 1 thereof, there is shown a machine body 1 having a flat boxlike shape open at the top and a plurality of underside rubber seats. The front edge of the body 1 is provided with a drum accommodating section 4 covered at the top with a separate cover 3. The top of the body is also provided on the rear edge side of the drum accommodating section 4 with a footboard 5. As shown in FIGS. 2 and 3, the footboard 5 is pivoted at its rear end to the rear end of the body 1 via the shaft 6, and it can be rotated in the vertical direction about the shaft 6 and upwardly biased by a pair of opposite side coil springs 7 provided within the body 1 so that it can be vertically moved as a runner treads over its top. The top of the footboard 5 is provided on opposite sides of a slightly forward portion with suitable step position indicating means (see FIG. 1). Referring to FIGS. 3 and 4, designated at 8 is a movable support rod vertically secured to the back of the front portion of the footboard 5. Extending sidewise from the lower end of the support rod 8 is a keep member 9, and a rotary arm 10 is provided under the keep member 9 so that it can be pushed down thereby. The rotary arm 10 has its stem pivoted by a pin 12 to a bracket 11 extending upright from the back plate of the body 1. Its tip is vertically movable between upper and lower stopper pins 13 and 14, and also upwardly biased by a spring 15 provided on its stem. At the tip of the rotary arm 10 a ratchet pawl 17 is pivoted by a pin 18 and is downwardly biased by a spring 16. At the front end side position of the ratchet pawl 17 there is provided a ratchet wheel 20 which is rotated pitch by pitch under the control of a stopper 19 with a motion of a ratchet pawl 17 accompanying the vertical movement of the rotary arm 10. A series of large and small transmitting gears **21*a*, 21*b*, 21*c*, 21*d*, 21*e* and 21*f* coupled at a suitable ratio to the rotation of the ratchet wheel 20 are rotatably provided on one side of the interior of the drum accommodating section of the body 1, and an elongate rotary drum 22 in coaxial arrangement with the last transmitting gear 21*f* is disposed within the drum accommodating section 4. The rotary drum 22 is adapted to rotate in the direction of arrow A via a clutch 23 with respect to the rotation of the last transmitting gear 21*f*. The clutch 23 is normally maintained in the "on" state by the spring force of the clutch spring 24, and it is provided with a clutch releasing mechanism 25. This clutch releasing mechanism 25 comprises an operating button 26, which is provided in the ceiling of the drum accommodating section 4, that is, the top of the cover 3, and upwardly biased by a spring 26*a* such that it can be depressed, and a releasing lever 27 decoupling the clutch 23 with its rotation by depressing the button 26 against the spring 24.**

Figure 5:
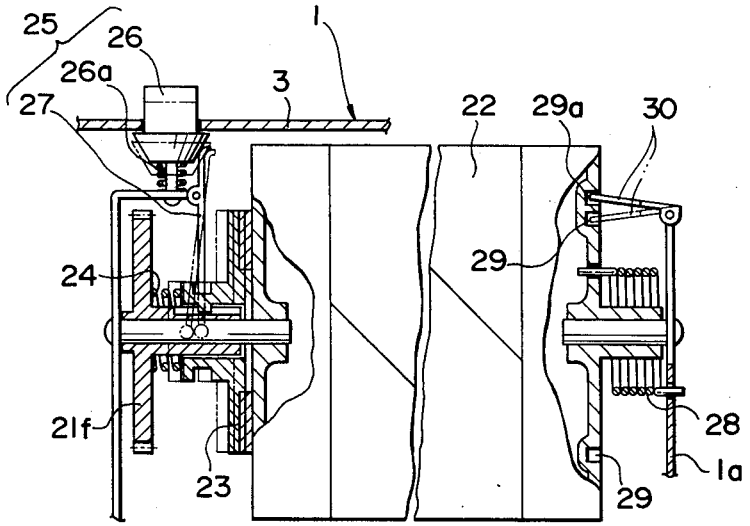
FIG. 5 is a partly broken-away plan view showing part of the opposite ends of a rotary drum.
Figure 6:
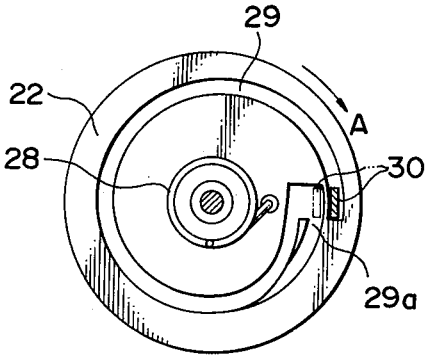
FIG. 6 is an end view of the rotary drum.
Figure 7:
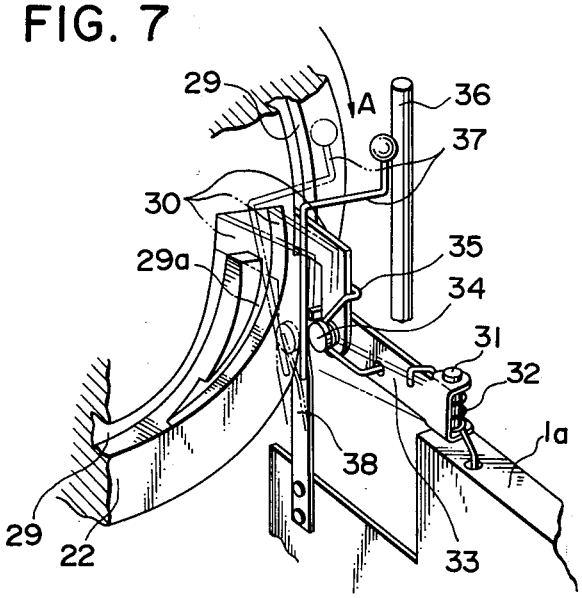
FIG. 7 is a fragmentary perspective view showing the other side end of the rotary drum.
Figure 8:
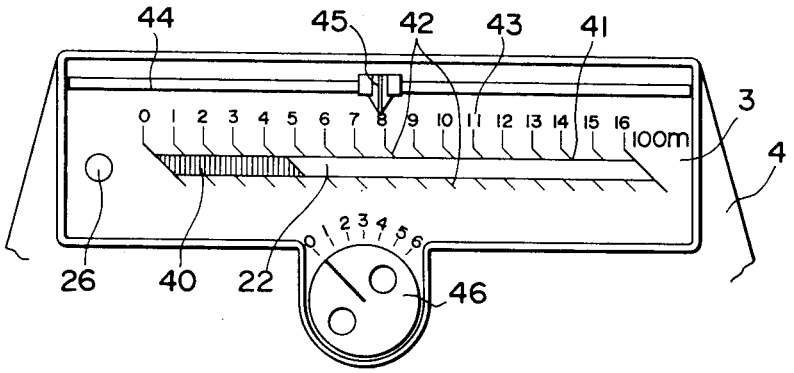
FIG. 8 is a plan view of the top of the drum accommodating portion.
Figure 9:
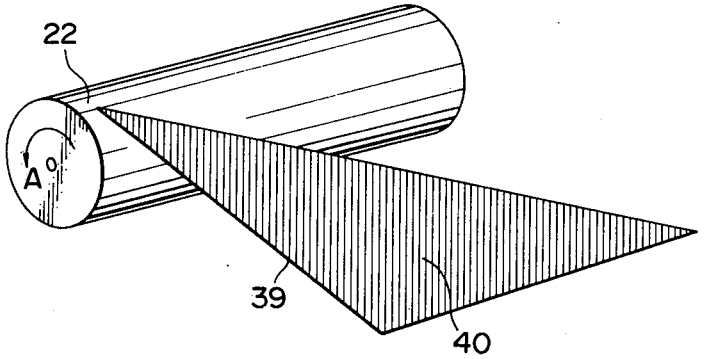
FIG. 9 is a perspective view showing means for forming colored indicating surface on the outer periphery of the drum.

At the other end of the drum 22 there is provided an inversion spring 28 having one end coupled to the aforesaid end wall of the drum 22 and the other end coupled to the chassis la within the body 1, as shown in FIG. 5, so that with the releasing of the clutch 23 the rotary drum 22 is automatically returned in the direction opposite to the direction of arrow A. Also, the other end wall of the rotary drum 22 is provided with a spiral guide groove with the radius of curvature gradually reducing toward the direction opposite to the direction of rotation of the drum 22 as indicated by the arrow A, as shown in FIGS. 5 to 7. A guide pawl 30 is received in the guide groove 29 so that the rotation of the rotary drum 22 is regulated within the range of one rotation, that is, 360°. As shown in FIG. 7, the guide pawl 30 is pivoted by a pin 34 to the free end of a guide arm 33, which has a stem pivoted by a pin 31 to the chassis la of the body 1 and is biased by a spring 32 toward the outer periphery of the rotary drum 22. The guide pawl 30 is biased by a spring 35 such that it is urged to rotate about the pin 34 toward the inner end of the guide groove 29. The guide groove 29 is provided at the other end with a triangular return guide groove **29*a*.** When the rotary drum 22 executes one rotation the guide pawl 30 is deviated at the end of the guide groove 29 toward the outer periphery of the drum 22 together with the guide arm 33 by the spring force of the spring 32 to enter into the return guide groove 29*a*, and with the rotational return of the rotary drum 22 by the spring force of the inversion spring 28 accompanying the releasing of the clutch it can return to the end of the guide groove 29. With the deviation of the guide pawl 30 at the end of the guide groove 29 toward the outer periphery a hammer 137 provided on the chassis la of the body 1 via an elastic member 38 is returned by the restoring force to sound an alarm bar 36 made of a metal rod extending upright in the neighborhood of the drum 22, thus informing of one rotation of the drum 22. The outer periphery of the rotary drum 22 is provided with a colored indicating surface 40 by applying a triangular red or like colored paper sheet 39, as shown in FIG. 9, with the width thereof gradually increasing from one end to the other end in the direction of axis opposite to the direction of rotation of the rotary drum 22 as indicated by arrow A. As shown in FIGS. 3 and 8, the top plate of the drum accommodating section 4, i.e., the top plate of the cover 3, positioned directly above the rotary drum 22 is provided with a slit-like indicating window 41 extending along the direction of axis of the drum 22 for displaying the colored indicating surface 40, and the opposite edges of the window 41 are provided with uni-interval indications 42 from one end to the other. The individual graduations are provided with respective FIG. 43 from "O" to "16", with each graduation representing 100 meters. Over the cover 3 there is provided a guide rail 44 of a T-shaped sectional profile and spaced from and extending parallel to the top of the cover 3. A running distance mark setting pointer 45 is slidably fitted on the rail 44 such that it can be set to a desired one of the graduations 42. Designated at 46 is a timer for setting the running period.

The operation of the machine according to the invention will now be described. As a runner treads on the footboard 5 as if he or she were running, the footboard 5 is vertically moved each time it is trodden upon. Thus, with each step the footboard 5 is rotated pitch by pitch via the push member 9, rotary arm 10, ratchet pawl 17 and ratchet gear 20. With the rotation of the ratchet wheel 20 the rotary drum 22 is gradually rotated in the direction of arrow A against the spring 28 via the series of transmitting gears 21*a* to 21*f* and clutch 23, and with the rotation of this rotary drum 22 the colored indicating surface 40 on the outer periphery is displayed with gradually increasing width from one end of the display window 41. The rate of increase of the width of the indicating surface 40 is set by the gear ratio of the series of the transmitting gears 21*a* to 21*f*. When a number of steps (for instance 80 steps) corresponding to the quantity of movement required for a usual person for running for 100 meters, the width of the colored indicating surface 40 is increased by one graduation from one end of the indicating window 41. As the running is continued, progress of the status is instantaneously known from the quantity of width increase and rate of increase of the width of the colored indicating surface 40, and the distance of running can be known from the FIG. 43 on the graduation 42 corresponding to the indicating position of the width.

When a number of steps corresponding to 1,600 meters is repeated, the rotary drum 22 substantially completes one rotation, with the colored indicating surface 40 displayed over the entire range of the indicating window 41 from one end to the other end, and the guide pawl 30 sliding within the guide groove 29 of the drum 22 reaches the end of the groove 29 and deviates toward the outer periphery of the drum together with the guide arm 33 by the spring force of the spring 32 to enter into the return guide groove portion 29*a*. At this time, the hammer 37 is also returned by the spring force to sound the alarm bar 36, producing an alarm sound. When the sound is heard, the rotary drum 22 can no longer be rotated. Thus, the test is stopped, and the operating button 26 of the clutch releasing mechanism 25 is depressed by a finger, whereby releasing lever 27 is rotated against the spring 24 to turn off the clutch 23. Then, the rotary drum 22 is rotated in the returning direction opposite to the direction of arrow A by the returning spring 28, and it is stopped at a position assumed when the initial end of the guide groove 29 is reached by the guide pawl 30, thus recovering the initial state. By sebsequently resuming the treading, the rotary drum 22 starts to rotate once again as mentioned earlier.

By operating the slide along the rail 44 to set the indicating pointer 45 to the graduation 42 before starting the mark of the distance covered by running can be set. Also, when the running period is set by the timer 46, it is possible to measure the distance covered within the present period of time.

As has been described in detail in the foregoing, according to the invention the number of steps of running or treading on the footboard can be displayed with the rate of increase of the width of colored indicating surface through a slit-like display window. Thus, compared to an abstract priorart system for indicating the figure representing the number of steps itself it is possible to know the state of increase of the steps in great detail, and also the running distance can be known for the rate of increase of width of the colored indicating surface. It will thus be understood that the machine can stimulate the desire for training and has very satisfactory effect as the indoor running machine.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An indoor running machine comprising:

a machine body having a drum accommodating section formed at its front edge;

a vertically movable footboard provided on top of the body on the rear end side of said drum accommodating section and spring biased in the upward direction;

a ratchet gear provided within the body and means associated with said movable footboard and body adapted to rotate said ratchet gear pitch by pitch with the vertical movement of said footboard; and a rotary drum provided within the drum accommodating section of the body and adapted to be coupled to the rotation of the ratchet wheel by means of a series of large and small transmitting gears, the outer periphery of said rotary drum being provided with a colored indicating surface of increasing width from one end to the other end in the direction of the axis opposite to the direction of rotation, the top of said drum accommodating section positioned directly above said rotary drum being provided with an display window of a slit-like form along the axial direction of the rotary drum, said display window being provided with running distance indicating graduations permitting the rate of increase of the colored indicating surface appearing on the display window with the rotation of said rotary drum to be read out in terms of the rnning distance.

* * * * *